US006336403B1

(12) United States Patent
Pitman

(10) Patent No.: US 6,336,403 B1
(45) Date of Patent: Jan. 8, 2002

(54) DAMPENING SYSTEM FOR PRINTING MACHINES

(75) Inventor: Jerry D. Pitman, Mitchellville, IA (US)

(73) Assignee: Townsend Industries, Inc., Altoona, IA (US)

( * ) Notice: Subject to any disclaimer, the term of this patent is extended or adjusted under 35 U.S.C. 154(b) by 0 days.

(21) Appl. No.: 09/543,067

(22) Filed: Apr. 5, 2000

(51) Int. Cl.[7] ..... B41F 7/40

(52) U.S. Cl. ..... 101/148; 101/352.01

(58) Field of Search ..... 101/148, 450.1, 101/351.1, 351.2, 351.3, 351.4, 352.01

(56) References Cited

U.S. PATENT DOCUMENTS

| | | | | | |
|---|---|---|---|---|---|
| 3,701,316 | A | | 10/1972 | Sylvester et al. | 101/148 |
| 4,290,360 | A | | 9/1981 | Fischer | 101/148 |
| 4,351,236 | A | | 9/1982 | Beisel et al. | 101/148 |
| 4,385,559 | A | * | 5/1983 | Jarach | 101/148 |
| 4,455,938 | A | | 6/1984 | Loudon | 101/148 |
| 4,470,347 | A | | 9/1984 | Johne et al. | 101/148 |
| 4,567,823 | A | * | 2/1986 | Hummel et al. | 101/148 |
| 4,741,269 | A | * | 5/1988 | Aylor et al. | 101/148 |
| 4,872,406 | A | | 10/1989 | Kusch | 101/148 |
| 4,876,958 | A | | 10/1989 | Townsend | 101/175 |
| 4,907,507 | A | * | 3/1990 | Ishii et al. | 101/148 |
| 5,158,017 | A | | 10/1992 | MacConnell et al. | 101/148 |
| 5,488,902 | A | | 2/1996 | Dorenkamp | 101/216 |
| 5,676,057 | A | * | 10/1997 | Hummel et al. | 101/148 |

FOREIGN PATENT DOCUMENTS

| | | | | |
|---|---|---|---|---|
| DE | PS 117844 | | 5/1976 | |
| JP | 2364 | * | 1/1985 | 101/148 |

OTHER PUBLICATIONS

Big Press Technology for Small Offset Presses, Printed in Canada.
Two Color—One Pass Printing, Varn Kompac.
Varn Kompac Automatic Dampener (34,000 Printers Can't be Wrong), 12/90.
Varn Cmpac Automatic Dampener (50,000 on Press).
Keep Your Balance, *American Printer*, Sep., 1992.
A Relatively Simple Method for Calculating The Dynamic Behavior of Inking Systems, John MacPhee, (1995).

* cited by examiner

*Primary Examiner*—Stephen R. Funk
(74) *Attorney, Agent, or Firm*—Zarley, McKee, Thomte, Voorhees & Sease, P.L.C.

(57) ABSTRACT

A fluid dampening system for a printing machine has a frame and a printing roll on the frame for holding a circular printing plate. A fluid reservoir is on the frame and a fountain roll is on the frame and is partially immersed in the fluid reservoir. A second roll is on the frame and is normally in surface contact with the fountain roll. A third roll is on the frame and is normally in surface contact with the fountain roll. A plurality of additional rolls are on the frame sequentially in surface contact with each other and with the third roll and the printing roll so that when all of the aforesaid rolls are rotated and in surface contact with each other, fluid will be transferred from the surface of the fountain roll to the surface of the third roll and sequentially on the surface of the additional rolls to the surface of the printing roll. A drive system on the frame connects the second roll and the third roll whereby the third roll drives the second roll which in turn which in turn drives the fountain roll. A linkage system is provided for breaking the fountain roll away from surface contact with the third roll while all the rolls are rotating to separate the fountain roll from surface contact with the third roll to prevent fluid from moving from a surface of the fountain roll to the third roll and to the rolls downstream from the third roll, while still permitting all the rolls to be simultaneously rotated.

4 Claims, 6 Drawing Sheets

38
34
34A
44
44A
46A
46
42
40
48
50
52
54
56
58

DAMPENING SYSTEM FOR PRINTING MACHINES

BACKGROUND OF THE INVENTION

In lithographic printing, it is desirable to have a thin layer of wetting liquid applied to the plate cylinder to enhance the application of ink and to better define the printing and non-printing areas of the printing plate. See U.S. Pat. Nos. 3,701,316 and 4,290,260, for example.

Existing devices which perform the dampening function normally utilize a system of rolls wherein a dampening roll provides a layer of liquid to be distributed by surface contact to a plurality of rolls in the system as the dampening roll is exposed to a reservoir of fluid. The system is shut down in times of non-printing. When the system is started again, substantial time is taken to obtain the proper ink and water balance on the rolls as the fountain roll again starts to move fluid from the reservoir over the surfaces of the rolls to the printing plate. As the system starts up, substantial amounts of paper are wasted until the ink-fluid balance is obtained.

It is therefore a principal object of this invention to provide a dampening system for printing machines wherein the fountain roll runs continuously in operative contact with the fluid reservoir, but where its surface contact with downstream rollers is interrupted when the printing system is discontinued.

A further object of this invention is to provide a dampening system for printing machines wherein the water accumulating on the surface of the fountain roll will go back into the fluid reservoir when the system is not printing and when it is not desirable to distribute fluid to the rolls of the system.

These and other objects will be apparent to those skilled in the art.

SUMMARY OF THE INVENTION

A fluid dampening system for a printing machine has a frame and a printing roll on the frame for holding a circular printing plate. A fluid reservoir is on the frame and a fountain roll is on the frame and is partially immersed in the fluid reservoir. A second roll is on the frame and is normally in surface contact with the fountain roll. A third roll is on the frame and is normally in surface contact with the fountain roll. A plurality of additional rolls are on the frame sequentially in surface contact with each other and with the third roll and the printing roll so that when all of the aforesaid rolls are rotated and in surface contact with each other, fluid will be transferred from the surface of the fountain roll to the surface of the third roll and sequentially on the surface of the additional rolls to the surface of the printing roll.

A drive system on the frame connects the second roll and the third roll whereby the third roll drives the second roll which in turn drives the fountain roll. A linkage system is provided for breaking the fountain roll away from surface contact with the third roll while all the rolls are rotating to separate the fountain roll from surface contact with the third roll to prevent fluid from moving from a surface of the fountain roll to the third roll and to the rolls downstream from the third roll, while still permitting all the rolls to be simultaneously rotated.

BRIEF DESCRIPTION OF THE DRAWINGS

Figure 1:
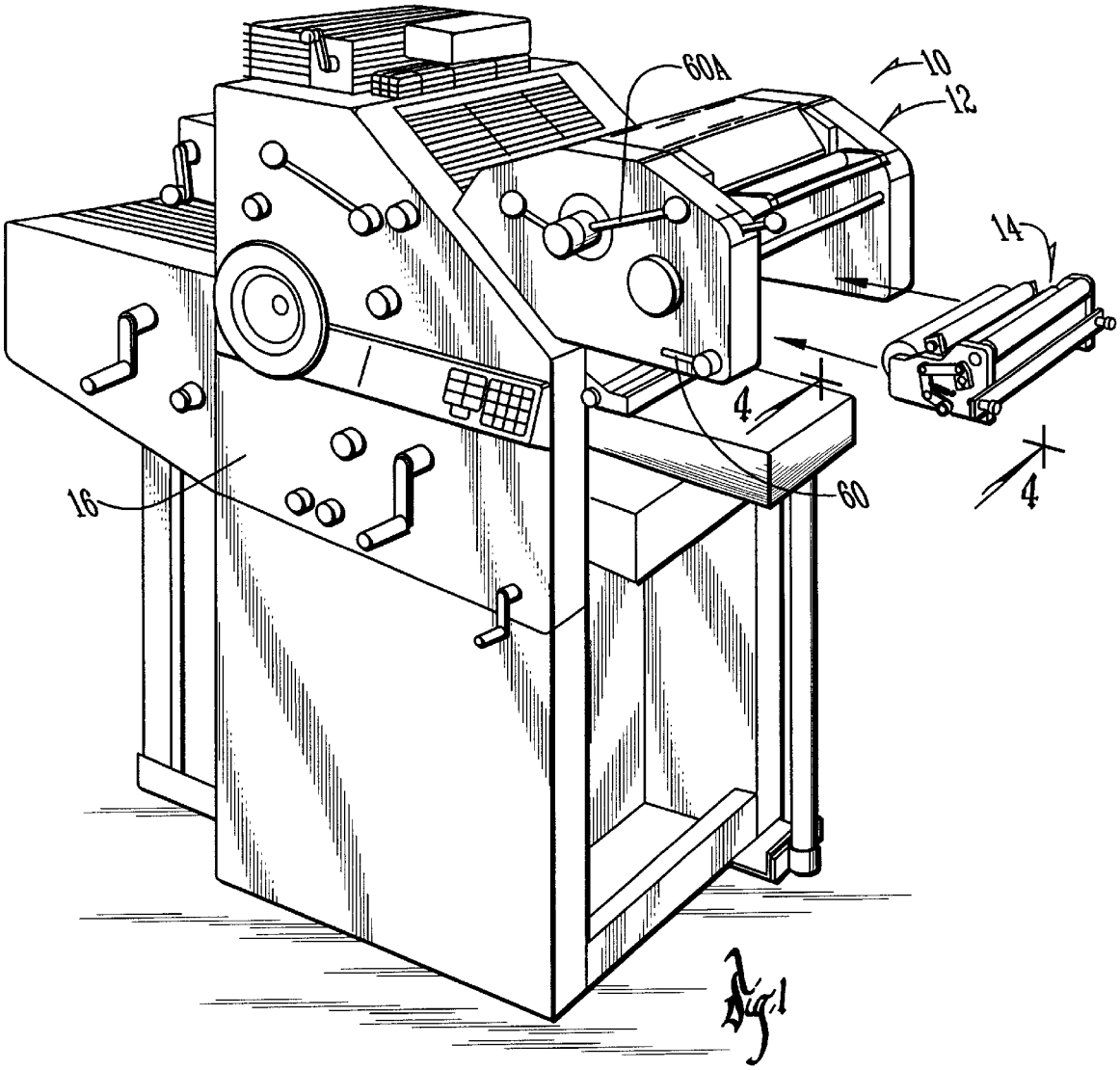
FIG. 1 is a perspective view of the machine of this invention.

With reference to FIG. 1, an offset printing press 10 of conventional construction has second-color auxiliary print unit 12 which slidably receives the dampening roll system 14 of this invention. The conventional rails for selectively receiving the roll system 14 within the unit 12 have been omitted from the drawings but are conventional in nature and well within the skill of one in the art. The machine 10 has a conventional frame 16, and the dampening roll system 14 has a sub-frame 18 which is best shown in FIGS. 4 and 5.

Figure 2:
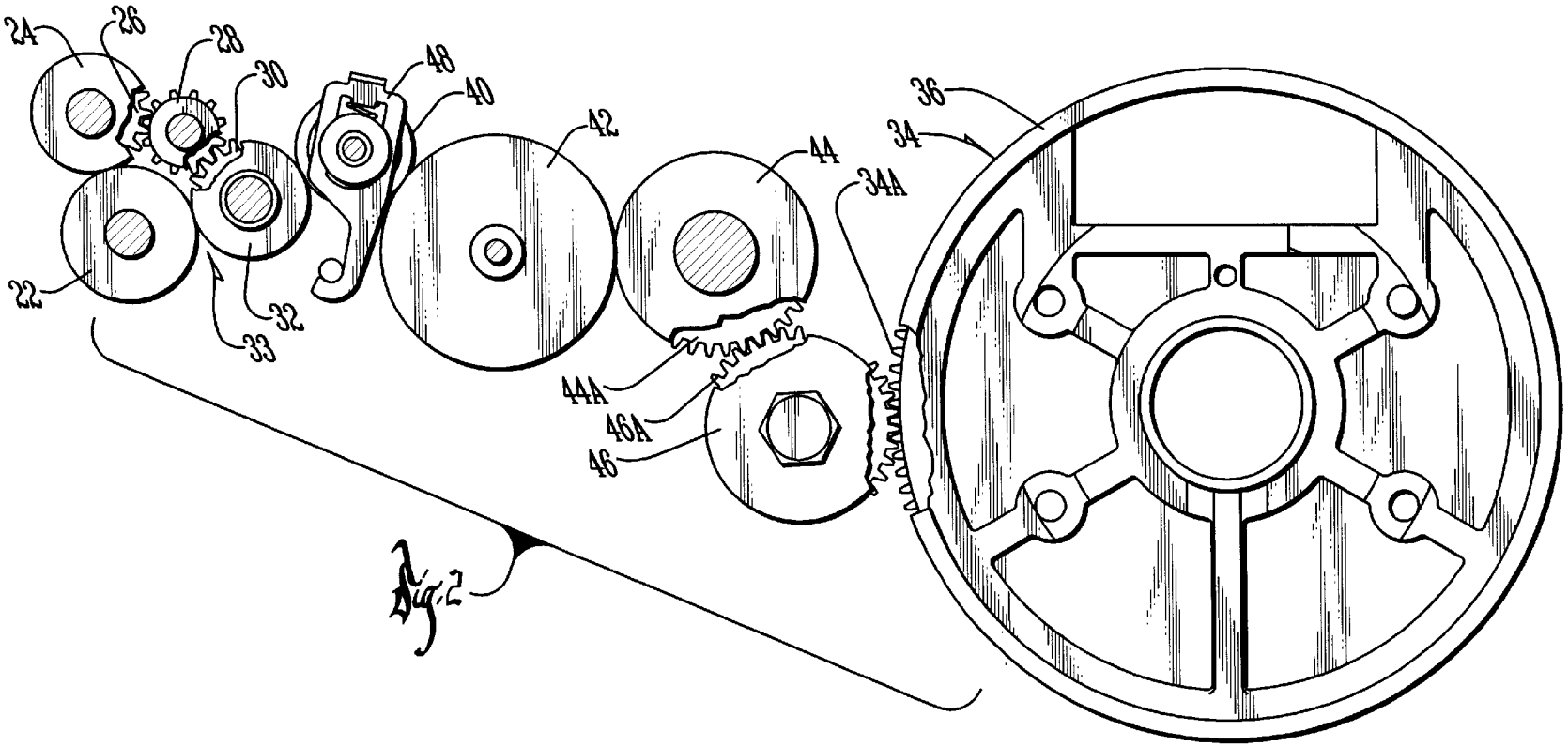
FIG. 2 is an exploded side elevational view of the various rolls of the machine of FIG. 1.
Figure 3:
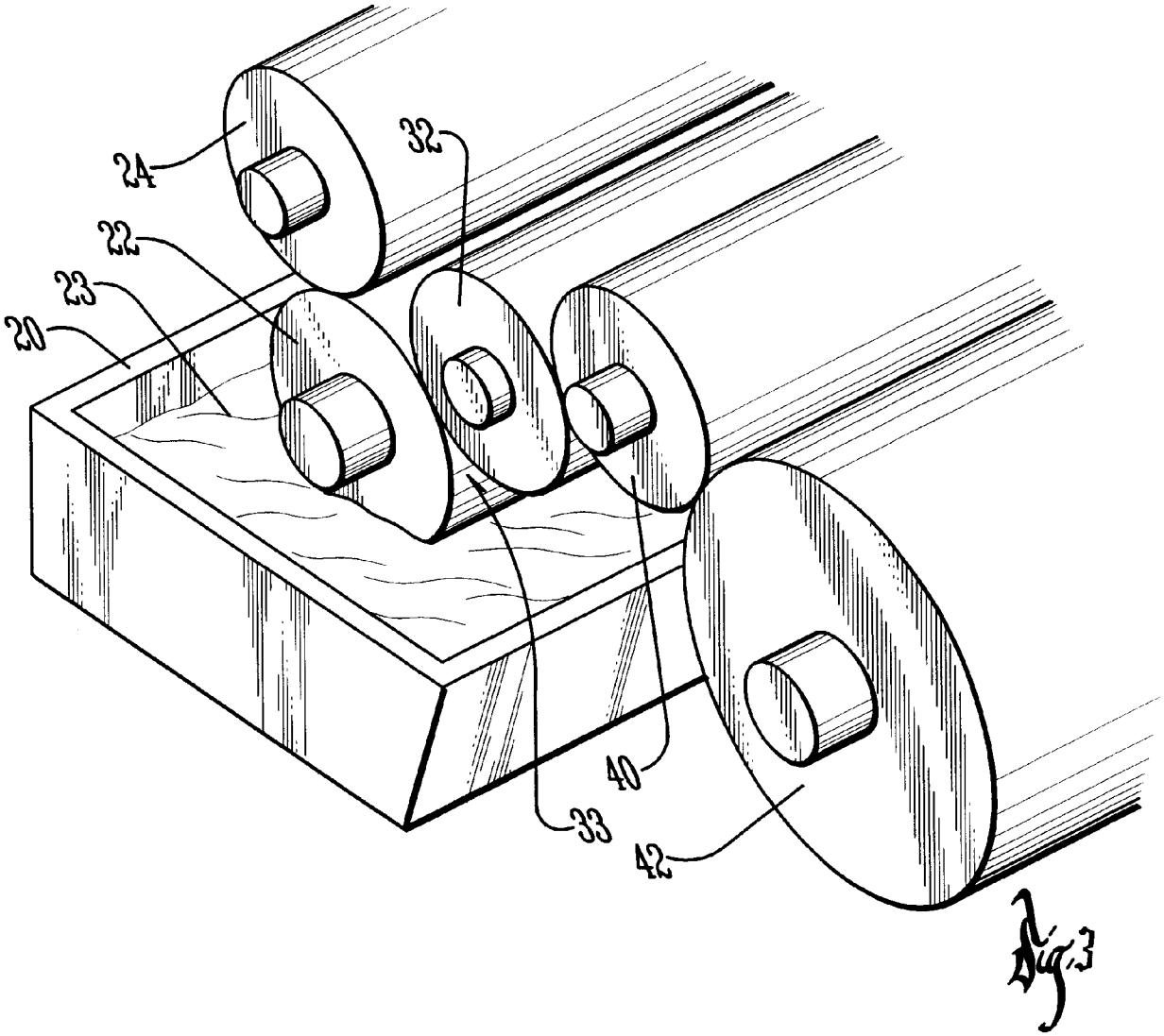
FIG. 3 is an enlarged scale perspective view of the fluid reservoir, the fountain roll and adjacent rolls with the gear segments removed.
Figure 6:
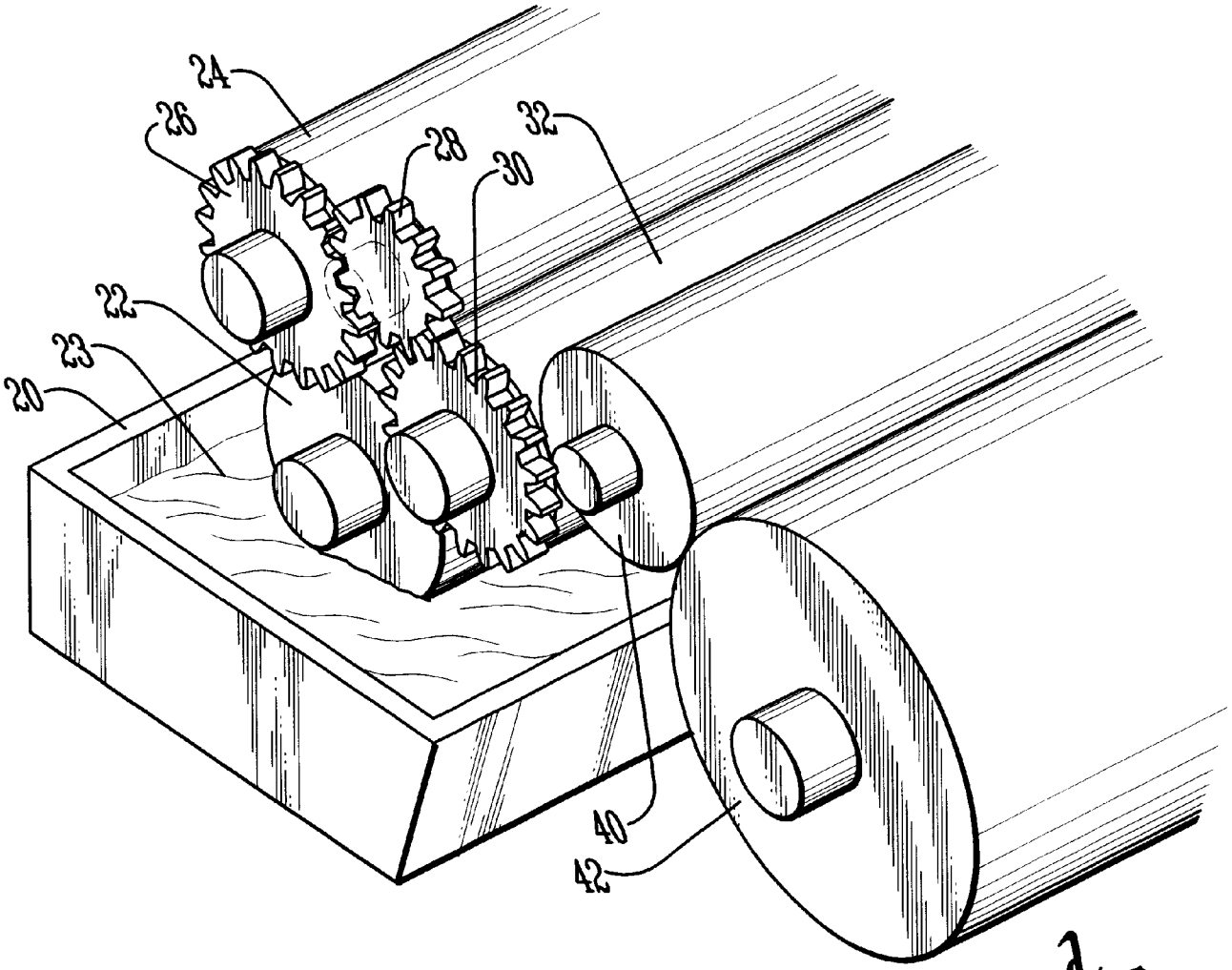
FIG. 6 is a view similar to that of FIG. 3 but shows the gear segments in place.

A fluid reservoir 20 shown best in FIGS. 3 and 6 is mounted on the frame. A dampening roll 22 is mounted on sub-frame 18 and is positioned so as to be partially immersed into the fluid 23 of reservoir 20. A second roll sometimes called a metering roll 24 is mounted on the sub-frame 18 and is parallel to and has surface contact with dampening roll 22. Second roll 24 is operationally connected by gear 26, idler gear 28 and gear 30 to a third roll 32 which is normally in surface contact with fountain roll 22 at nip point 33 (FIG. 3). A conventional printing roll 34 is mounted on sub-frame 18 and has a gear 34A associated therewith. A printing plate 36 is mounted on the surface of roll 34 in conventional fashion. An intervening transfer roll 40 is mounted in parallel fashion and has surface contact with roll 32; and a further transfer roll 42 is disposed on frame 18 in parallel fashion to roll 40 and is in surface contact therewith. A further transfer roll 44 has gear 44A associated therewith and is positioned parallel to and in surface contact with roll 42. Similarly, a further transfer roll 46 is positioned in parallel fashion to roll 44 and is in surface contact therewith. Roll 46 has gear 46A associated therewith in mesh with gear 44A on roll 44. A conventional spring-pressure element 48 is mounted on roll 40 to yieldingly hold roll 40 in pressure contact with both rolls 32 and 42 as best shown in FIG. 2. The gears 46A on roll 46 are also in mesh with the gears 34A on printing roll 34.

Figure 4:
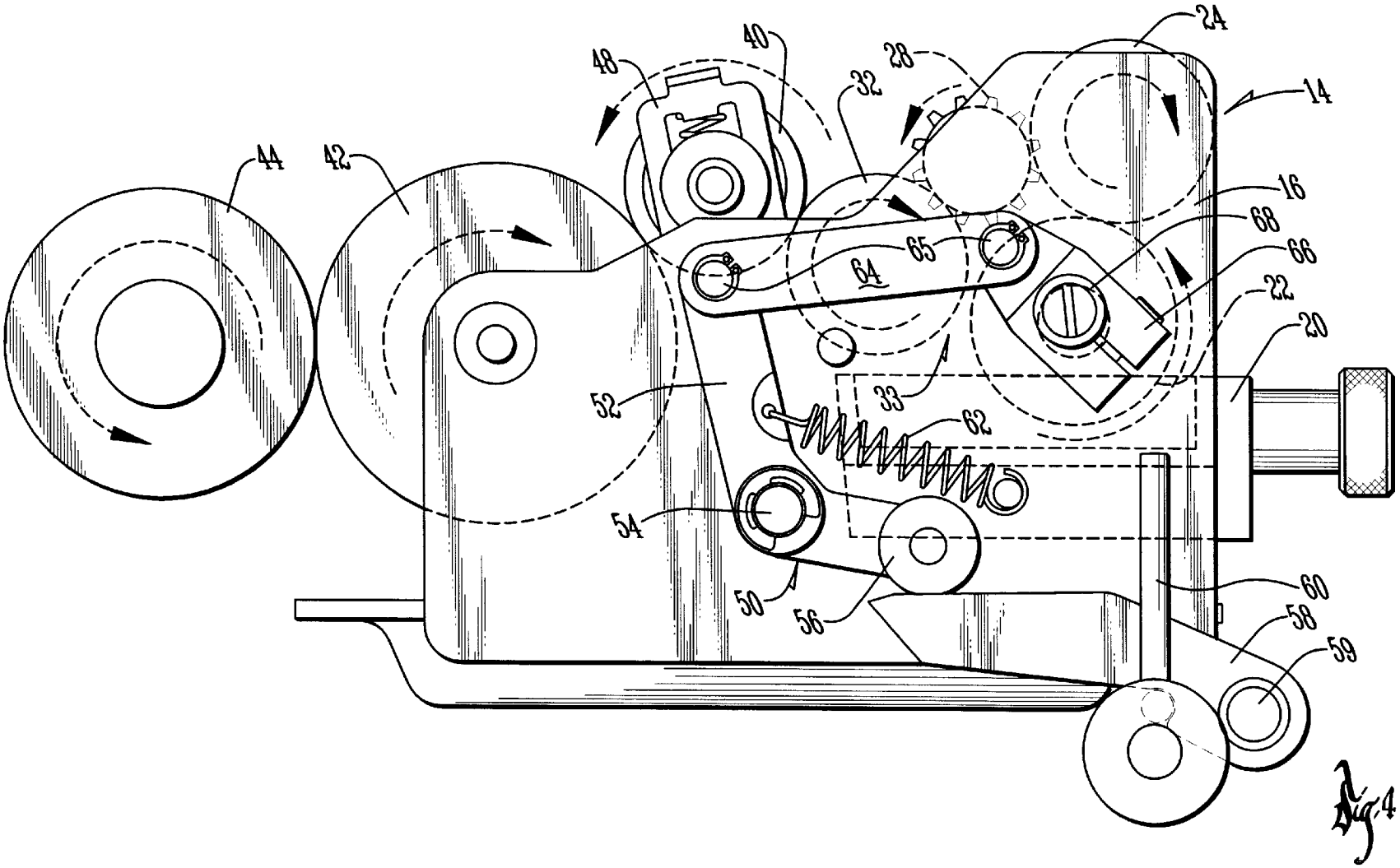
FIG. 4 is an enlarged scale side elevational view taken on line 4—4 of FIG. 1 and shows the fountain roll in its inoperative position.
Figure 5:
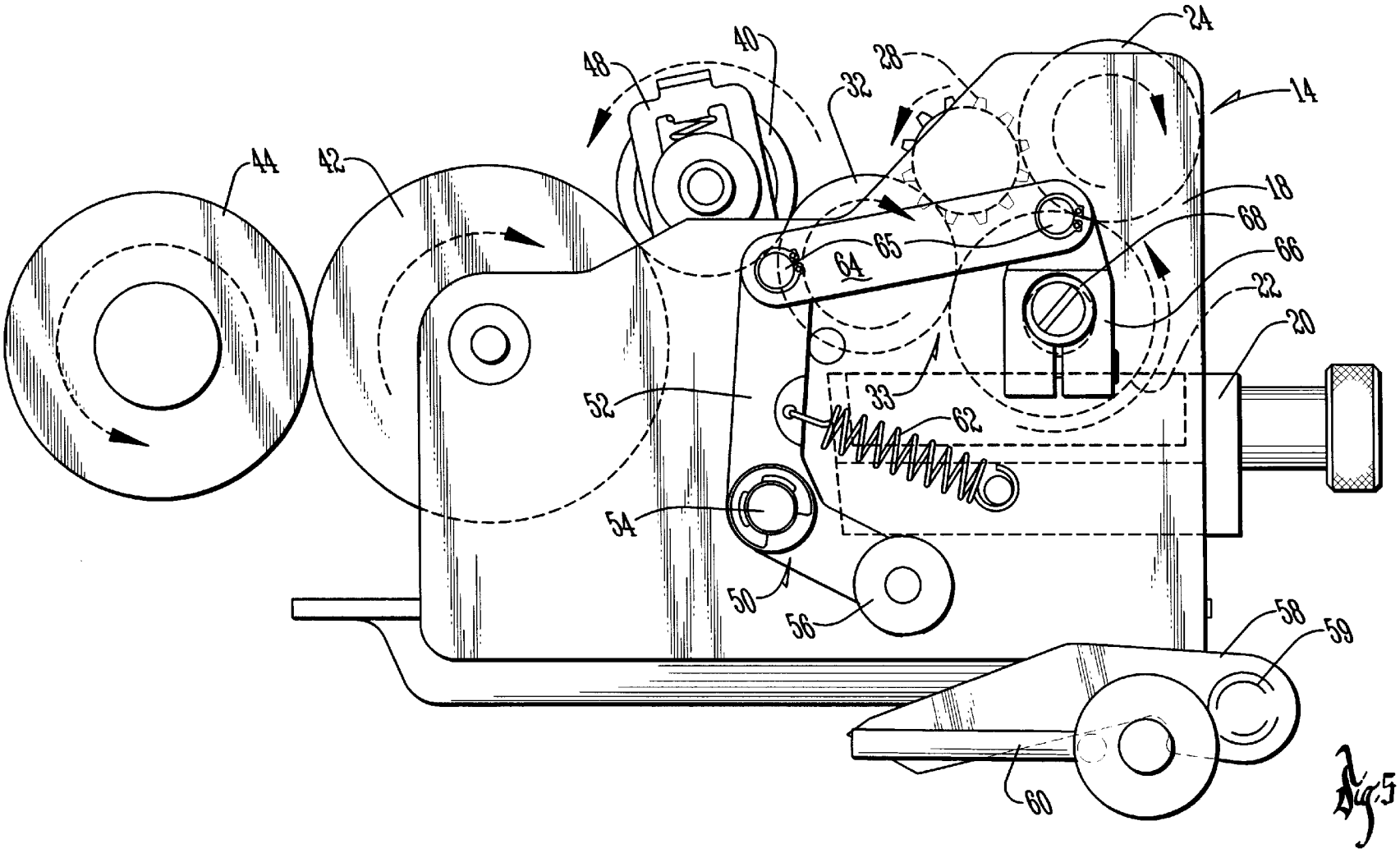
FIG. 5 is a view similar to that of FIG. 4 but shows the fountain roll in its operative position.

With reference to FIGS. 4 and 5, a link assembly 50 is mounted on sub-frame 18 and includes an L-shaped link 52 which is pivoted to sub-frame 18 by pivot pin 54. A conventional roller 56 is mounted on the lower end of link 52 and engages an inner end of arm 58 which is pivotally secured to the frame 12 by pin 59. Manually operated handle 60 is positioned with respect to arm 58 so that movement of the handle 60 from the position shown in FIG. 5 to the position of FIG. 4 will cause the fountain roll 22 to separate from surface contact with the third roll 32 as shown in FIG. 4, and as will be explained in more detail hereafter. A spring 62 is secured by one of its ends to link 52 with the other end being secured to sub-frame 18 so as to yieldingly hold the link 52 in the normal operating position for the fountain roll 22 as shown in FIG. 5.

A horizontal link 64 is pivotally secured by its ends through pivot pins 65, with one end being pivotally secured to the upper end of link 52 by a first pin 65, and the other end being connected by a second pin 65 to axle clamp 66. The axle clamp is also rigidly secured to the eccentric shaft 68 of fountain roll 22.

In operation, the handle 60 is used to control the dampening roll system 14 and the unit 12 through various stages of the printing operation. However, the two operational positions most relevant to this invention are shown in FIGS. 4 and 5. It should be noted that suitable operational power is supplied to roll 34 whereupon the rolls 46 and 44 are rotated by reason of the intermeshed gears 34A with 46A, and 46A with gears 44A. Roll 44 is rotated by intermeshed gears 44A and 46A, and rotates roll 42 surface contact therewith. Roll 40 is rotated by reason of its surface contact with roll 42. Roll 32 is rotated through its surface contact with roll 40. The rotation of roll 32 imparts rotation motion to roll 24 through gears 30, idling gear 28 and gear 26 (FIG. 2). Roll 24 imparts rotational motion to fountain roll 22 through its surface contact with roll 22.

When the handle 60 is in the position shown in FIG. 5, the spring 62 maintains the links 52 and 64 and axle clamp 66 in a position to maintain the fountain roll 22 in surface contact with roll 32. When in that position, the fountain roll 22 acquires liquid on the surface thereof from the reservoir 20. Water from the reservoir is transmitted from roll 22 to third roll 32 through the surface contact between the two rolls. The moisture on the surface of roll 32 is thereafter sequentially transmitted to the intervening transfer rolls 40, 42, 44, 46 and 34 by the surface contact therebetween whereupon an appropriate film of fluid is deposited on printing plate 36.

When it is desired to interrupt the printing activity, the handle 60 is moved to the position of FIG. 4 which causes the link assembly 50 to move from the position of FIG. 5 to the position of FIG. 4. This causes the rotation of the eccentric shaft 68 for fountain roll 22 to move from the position of FIG. 5 to FIG. 4 which in turn separates the rolls 22 and 32 at the nip point 33 as best shown in FIG. 4. In this situation, all of the rolls in the system, including the intervening rolls 40, 42, 44 and 46 which extend between roll 32 and roll 34 continue to rotate. However, no moisture or liquid is transferred during that stage of the operation from fountain roll 22 because it has no surface contact with roll 32. Any excess moisture accumulating on roll 22 falls by gravity back into the reservoir 20.

When it is desired to resume printing, the roll 22 can be immediately put in its operating position by moving the handle 60 from a position in FIG. 4 back to the position in FIG. 5. No time is lost for the fountain roll to accumulate a layer of moisture on its outer surface because that moisture is already there through its constant rotation during the inoperative printing stage.

Master control handle 60A (FIG. 1) which controls all operational phases of the press 10 can also be used by suitable connections (not shown) to move the roll 22 back and forth between the inoperative position of FIG. 4 to the operative position of FIG. 5.

From the foregoing, it is seen that the present invention substantially speeds up the process of going from the inoperative to the operative dampening mode, and substantial time is saved because the fountain roll is always ready to go to its operative position.

Thus, this invention achieves at least all of its stated objectives.

What is claimed is:

1. A fluid dampening system for a printing machine, comprising, a frame, a printing roll on the frame for holding a circular printing plate, a fluid reservoir on the frame, a fountain roll on the frame at least partially immersed in the fluid reservoir, a second roll on the frame in surface contact with the fountain roll, a third roll on the frame in surface contact with the fountain roll, a plurality of additional rolls on the frame sequentially in surface contact with each other, and directly or indirectly in operational surface contact with the third roll and the printing roll so that when all the aforesaid rolls are rotated and in surface contact with each other, fluid will be transferred from the surface of the fountain roll to the surface of the third roll and then sequentially on the surfaces of the additional rolls to the surface of the printing roll, means for rotating the rolls including a drive system connecting the second roll and the third roll whereby the third roll drives the second roll which in turn drives the fountain roll, and means for breaking the fountain roll away from surface contact with the third roll while all the rolls are rotating to separate the fountain roll from surface contact with the third roll to prevent fluid from moving from a surface of the fountain roll to the third roll and to the rolls downstream from the third roll, while still permitting all rolls to be simultaneously rotated.

2. The system of claim 1 wherein the means for breaking the fountain roll away from surface contact with the third roll includes an eccentric axis of rotation on the fountain roll such that while in a first position the fountain roll is in surface contact with the third roll, and while in a second position the fountain roll disengages surface contact with the third roll, and means for moving the fountain roll back and forth between the first and second positions.

3. The system of claim 2 wherein a cam actuated linkage is connected to the frame and the axis of rotation to move the fountain roll between the first and second positions.

4. The system of claim 3 wherein the cam actuated linkage is operatively connected to a manual operated lever.

* * * * *